US007988489B2

(12) United States Patent
Schmitt et al.

(10) Patent No.: US 7,988,489 B2
(45) Date of Patent: Aug. 2, 2011

(54) ELECTRICAL CONNECTOR

(75) Inventors: Gilles Schmitt, Senantes (FR); Sébastien Deubel, Longvilliers (FR)

(73) Assignee: FCI, Versailles (FR)

( * ) Notice: Subject to any disclaimer, the term of this patent is extended or adjusted under 35 U.S.C. 154(b) by 29 days.

(21) Appl. No.: 12/309,122

(22) PCT Filed: Jul. 13, 2006

(86) PCT No.: PCT/IB2006/003411

§ 371 (c)(1),
(2), (4) Date: Sep. 4, 2009

(87) PCT Pub. No.: WO2008/010016

PCT Pub. Date: Jan. 24, 2008

(65) Prior Publication Data

US 2010/0022127 A1 Jan. 28, 2010

(51) Int. Cl.
*H01R 13/40* (2006.01)

(52) U.S. Cl. ..... 439/595; 439/752

(58) Field of Classification Search ..... 439/595, 439/752

See application file for complete search history.

(56) References Cited

U.S. PATENT DOCUMENTS

| | | | | |
|---|---|---|---|---|
| 4,973,268 | A | 11/1990 | Smith et al. | 439/595 |
| 2006/0052004 | A1 | 3/2006 | Yamashita | 439/595 |
| 2006/0141862 | A1 * | 6/2006 | Machida et al. | 439/595 |

* cited by examiner

*Primary Examiner* — Ross N Gushi
(74) *Attorney, Agent, or Firm* — Harrington & Smith

(57) ABSTRACT

The invention proposes a housing of an electrical connector including a contact holder and a front grid arranged for being mounted together, wherein: —the contact holder includes channels for receiving electrical contacts within, each channel being limited by resilient members stressable by an electrical contact whose position in the channel is not correct; —the front grid comprises a front panel with a plurality of transversal connecting windows for facing corresponding channels of the contact holder; characterized in that the housing includes members for locking the front grid to the contact holder by translating the front grid with respect to the contact holder according to a lateral direction.

19 Claims, 7 Drawing Sheets

ELECTRICAL CONNECTOR

FIELD OF THE INVENTION

The invention relates to the field of the electrical connectors, and especially to the field of the female electrical connectors.

More particularly, the invention relates to the housings of female electrical connectors.

Such housings comprise a contact holder and a front grid arranged for being mounted together The contact holder is typically a plastic element comprising a rear panel and lateral panels defining an internal cavity opened at a front side for receiving the front grid. Inside the cavity, a plurality of channels is provided in a plastic core extending from the rear panel according to a plugging axis. These channels are designed for receiving electrical contacts engaged through the rear panel.

In the said core, each channel is limited by lateral walls comprising opposite locking resilient pawls extending generally axial from the associated lateral wall. Each locking pawl is able to clip an electrical contact in order to fix it in the channel at a correct position.

The front grid comprises a front panel with a plurality of transversal connecting windows for facing corresponding channels of the contact holder. The front panel is then arranged for receiving the pins of a counterpart male electrical connector to be connected to the said electrical contacts.

The front grid is then mounted onto the core of the contact holder according to the said plugging axis, and fixed into the contact holder thanks to fixing elements.

TECHNICAL BACKGROUND

A problem is to ensure that the electrical contacts are in a correct position inside the channels, i.e. to check if the connector is correctly mounted.

In order to test if the electrical contacts are in a correct position in their respective channels, it is known to provide transversal testing windows through the front panel of the front grid. Each testing window is associated with a neighbored connecting window such that a testing tool engaged through a testing window can contact the electrical contact facing the associated connecting window.

The testing method consists in electrically linking the testing tool to the tested electrical contact via an external circuit. Then, the circuit is electrically closed only if the testing tool is contacting the electrical contact.

Accordingly, if a voltage is applied to this circuit, the measurement of a current will indicate that the testing tool contacts the said electrical contact, and then the electrical contact is in a correct position.

However, this method is long to implement (each channel has to be individually checked) and necessitates the use of a testing tool.

Another technique is to provide the front grid with rigid elements for preventing the electrical contacts going beyond their correct positions.

But this technique does not allow the operator to detect that an electrical contact is below the correct position in the channel.

Additionally, these known techniques do not prevent the use of a connector that has been incorrectly mounted.

SUMMARY OF THE INVENTION

In order to overcome these problems, the invention proposes, according to a first aspect, a housing of an electrical connector comprising a contact holder and a front grid arranged for being mounted together, wherein:

- the contact holder comprises channels extending parallel to a plugging axis for receiving electrical contacts within, each channel being limited by at least one axial lateral wall comprising resilient members; wherein each resilient element can be stressed in a stress direction perpendicular to the plugging axis by an electrical contact whose position in the channel is not correct;
- the front grid comprises a front panel with a plurality of transversal connecting windows for facing corresponding channels of the contact holder;

characterized in that the housing comprises members for locking the front grid to the contact holder by translating the front grid with respect to the contact holder according to a locking direction perpendicular to the said stress direction and to the plugging axis, in that the front grid further comprises rear members deflectable into the said stress direction by a neighbored stressed resilient members, and in that the contact holder comprises stop members arranged for stopping corresponding deflectable members, while the front grid is translated towards the locking direction, if the deflectable members are deflected, such that the front grid can not be locked to the contact holder if one of the rear members is deflected.

Optional characteristics of the said housing are:

- the deflectable members are deflectable leafs extending parallel to a plane perpendicular to the stress direction, the stop members are stop walls perpendicular to the locking direction, two successive stop walls being separated to each other by a recess or a crenel, and the stop walls and the deflectable members are arranged such that each deflectable element is housed in a corresponding recess if it is sufficiently deflected according to the stress direction;
- the resilient members are locking pawls able to lock the electrical contacts into the associated channels at correct positions, and the front grid further comprises rear rigid members arranged for being in contact with corresponding locking pawls in order to strain them to stay in their locking position;
- the rigid members are leafs extending parallel to a plane, perpendicular to the locking direction;
- the housing is designed for further receiving a sealing element between the front grid and the contact holder;
- the housing further comprises members for mounting the front grid to the contact holder according to the plugging axis;
- the said carrier holder comprises a rear panel comprising openings for engaging the electrical contact into the channels and a lateral shell extending from the rear panel for defining a front casing opened at a front side of the contact holder for engaging the front grid within, the said channels are provided in a core portion of the contact carrier that extends inside the casing from the rear panel according to the plugging axis, and the core portion further comprises the said stop members;
- the core portion is designed for holding an annular sealing element on its peripheral part;
- the said front grid comprises a lateral shell extending from the front panel defining a rear casing opened at the rear side for receiving the core portion within, and the rear deflectable members extend inside the rear cavity from the front panel.

According to a second aspect, the invention proposes a housing of an electrical connector comprising a contact holder and a front grid arranged for being mounted together, with:

mounting members allowing the montage of the front grid to the contact holder according to a plugging axis; and locking members allowing the locking of the mounted front grid to the contact holder by translating the front grid with respect to the contact holder into a locking direction perpendicular to the plugging axis;

and wherein:

the contact holder comprises:

a rear panel having transversal openings;

a lateral shell;

a front cavity defined by the said rear panel and lateral shell, and opened at a front side for receiving the front grid;

a core portion extending inside the cavity from the rear panel, having a plurality of inner channels extending parallel to the plugging axis from the openings of the rear panel for receiving corresponding electrical contacts within, each channel being limited by at least one axial lateral wall comprising one resilient locking pawl extending generally axial from the associated lateral wall; wherein each locking pawl is able to lock an electrical contact into the associated channel at a correct position and is able to be stressed outwards the axis of the associated channel in a stress direction that is perpendicular to the plugging axis and to the locking direction if the position of an electrical contact in the channel is not correct;

the front grid comprises a front panel with a plurality of transversal connecting windows for facing corresponding channels of the contact holder;

rear members deflectable in the said stress direction by a neighbored stressed locking pawl;

wherein the contact holder further comprises stop walls arranged for stopping corresponding deflectable members, while the front grid is translated towards the locking direction, if the deflectable members are deflected, such that the front grid can not be locked to the contact holder if one of the rear members is deflected.

Optional characteristics of the said second housing are:

the deflectable members are deflectable leafs extending parallel to a plane perpendicular to the stress direction, the stop walls are perpendicular to the locking direction, two successive stop walls being separated to each other by a recess or a crenel, and the stop walls and the deflectable members are arranged such that each deflectable element is housed in a corresponding recess separating two successive stop walls if it is sufficiently deflected according to the stress direction;

the said front grid comprises lateral shell extending from the front panel for defining a rear casing opened at the rear side for receiving the core portion within, and the deflectable members extend in the casing from the rear side of the front panel of the front grid;

the front grid further comprises rear rigid members arranged for being in contact with corresponding locking pawls in order, to strain them to stay in their locking position;

the rigid members are leafs extending parallel to a plane perpendicular to the locking direction;

the rigid members and the deflectable members are alternate along at least one rank;

the contact holder is arranged for receiving a lateral U-bolt, in order to latch the electrical connector to the electrical contacts.

According to a third aspect, the invention proposes a method for mounting an electrical connector comprising a contact holder and a front grid, the contact holder comprising a plurality of channels for receiving within electrical contacts according to a plugging axis, the front grid comprising a front panel with a plurality of transversal connecting windows for facing corresponding channels of the contact holder; wherein the method comprises:

(a) mounting the front grid to the contact holder according to the plugging axis such that the said connecting windows are offset from the channels in a direction perpendicular to the plugging axis;

(b) positioning the electrical contacts in the channels of the contact holder;

(c) locking the front grid to the contact holder by translating the front grid in the said direction perpendicular to the plugging axis, in order to place the connecting windows facing corresponding channels.

DETAILED DESCRIPTION OF THE INVENTION

Figure 1:
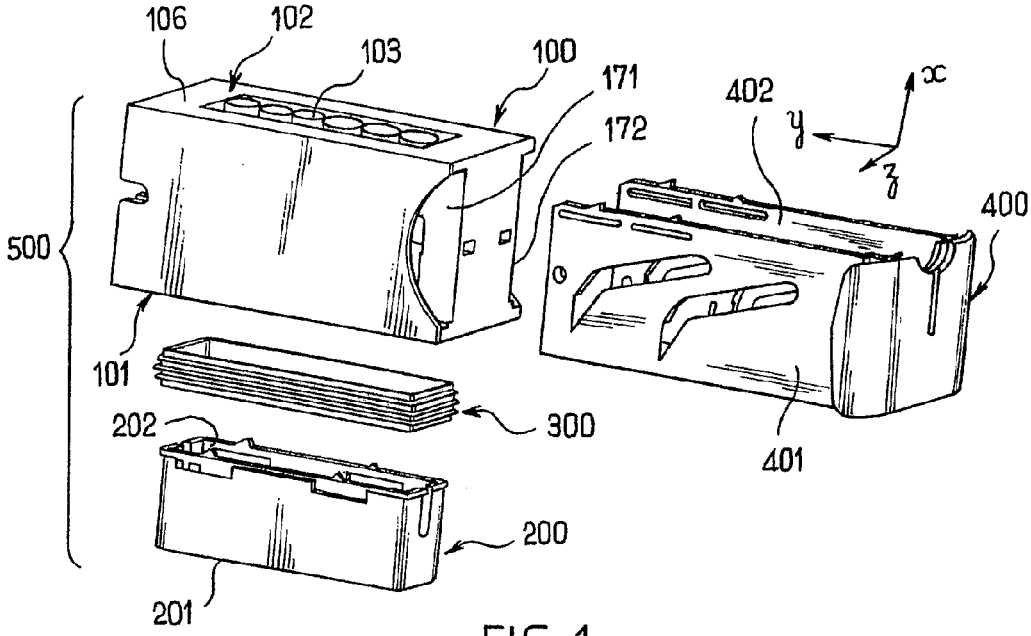
FIG. 1 shows an exploded view of different elements of an electrical connector according to the invention.

According to FIG. 1, a housing of an electrical connector is shown.

This housing comprises:

a contact holder 100 for receiving electrical contacts;

a front grid 200 to be mounted to the contact holder 100 and arranged for receiving connecting elements of a counterpart electrical connector along a plugging axis (the X-axis).

Preferably, a sealing element 300 is provided between the contact holder 100 and the front grid 200 in order to prevent the connector from any moisture and dust.

The contact holder 100 has a front side 101 for receiving the front grid 200, a back side 102, and a plurality of channels (not shown in FIG. 1) extending according to the X-axis from the back side 102. The channels are designed for receiving electrical contacts engaged in the contact holder 100 from its back side 102, through openings 103.

Electrical contacts are typically terminal parts of an external terminal network.

Optionally, the contact holder 100 is designed for receiving a lateral U-bolt 400 according to a direction (Y-axis) perpendicular to the X-axis. For this purpose, two opposed outer sides 701 and 702 of the contact holder 100 are each made with two parallel walls separated by a gap for engaging within respective legs of the U-bolt 400.

As it is well known, the U-bolt 400 is intended to bolt the electrical connector 500 once the electrical contacts are positioned in the contact holder 100, and once the sealing element 300 and the front grid 200 are mounted in the contact holder 100. The U-bolt 400 ensures then the electrical connector 500 not being dismounted from the external electrical network.

Figure 2:
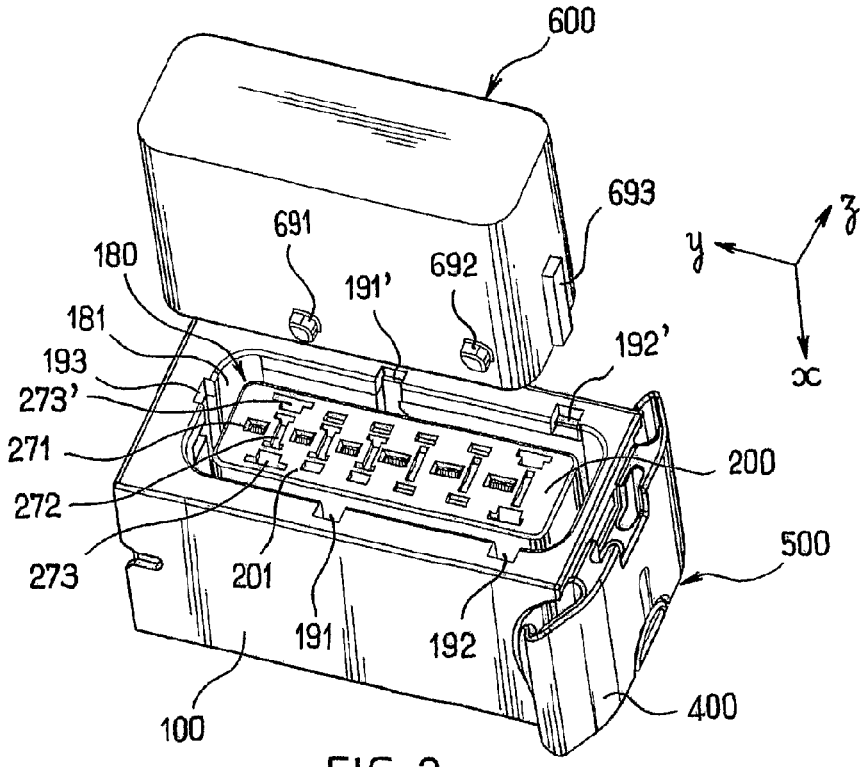
FIG. 2 shows a perspective view of the plugging step between an electrical connector according to the invention and a counterpart electrical connector.

FIG. 2 shows an electrical connector 500 once the electrical contacts (not shown) are positioned in the contact holder 100 and once the sealing element 300 (not shown), the front grid 200, and the U-bolt 400 are mounted to the contact holder 100. Additionally, the FIG. 2 shows a counterpart electrical connector 600 to be plugged with the electrical connector 500.

The sealing element 300 (not shown here) and the front grid 200 are received in a cavity 180 provided in the contact holder 100 and opened at the front side 101 of the contact holder 100, as explained later.

The cavity 180 is designed for further receiving the counterpart electrical connector 600. Thus, once the electrical connector 500 is mounted, a gap 181 remains from the initial cavity 180, around the front grid 200, for receiving a complementary part of the counterpart electrical connector 600.

Inner faces of lateral walls defining the cavity of the contact holder 100 can comprise guiding elements, like grooves 191-192-191'-192'-193, for receiving complementary guiding elements, like ribs 693 or shoulders 691-692, provided on the outer lateral faces of the counterpart electrical connector 600. Thus, the plugging of the two connectors 500-600 is guided, and easier to operate.

The front grid 200 comprises a front panel 201 having a plurality of transversal connecting windows 271 for receiving the counterpart connecting elements of the counterpart electrical connector 600 (not shown). Optionally, the front panel 201 may also comprise some additional windows, like testing windows 272 (intended to receive a testing tool for testing if the electrical contacts in the contact carrier are in a correct position) and/or dismounting window 273 (intended to receive a tool for disengaging the electrical contacts from the contact holder 100).

Figure 3A:
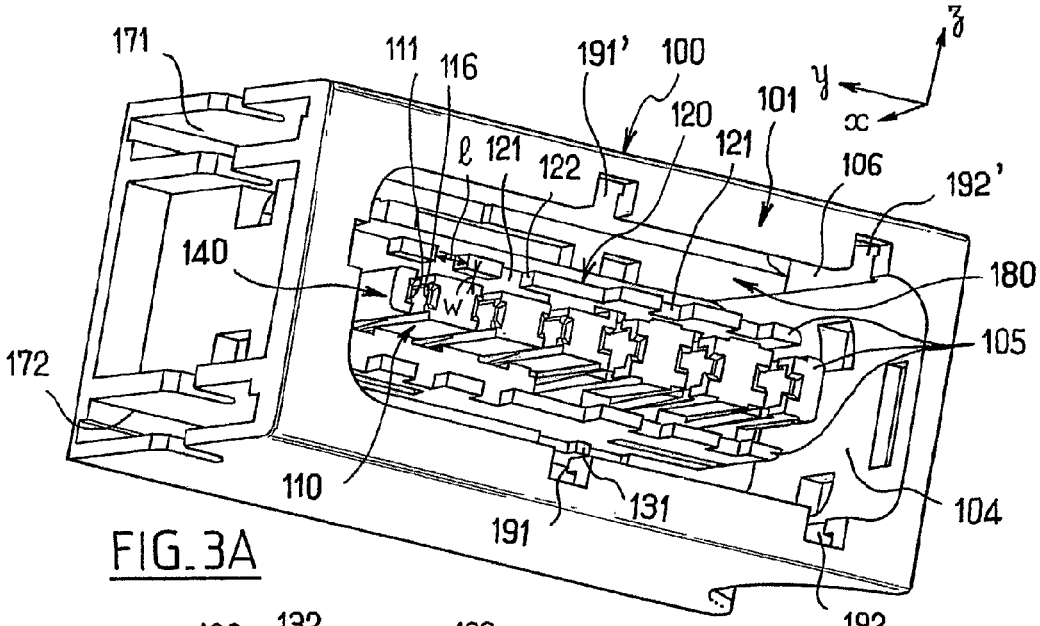
FIGS. 3A and 3B show perspective front views of a contact holder of an electrical connector according to the invention.
Figure 3B:
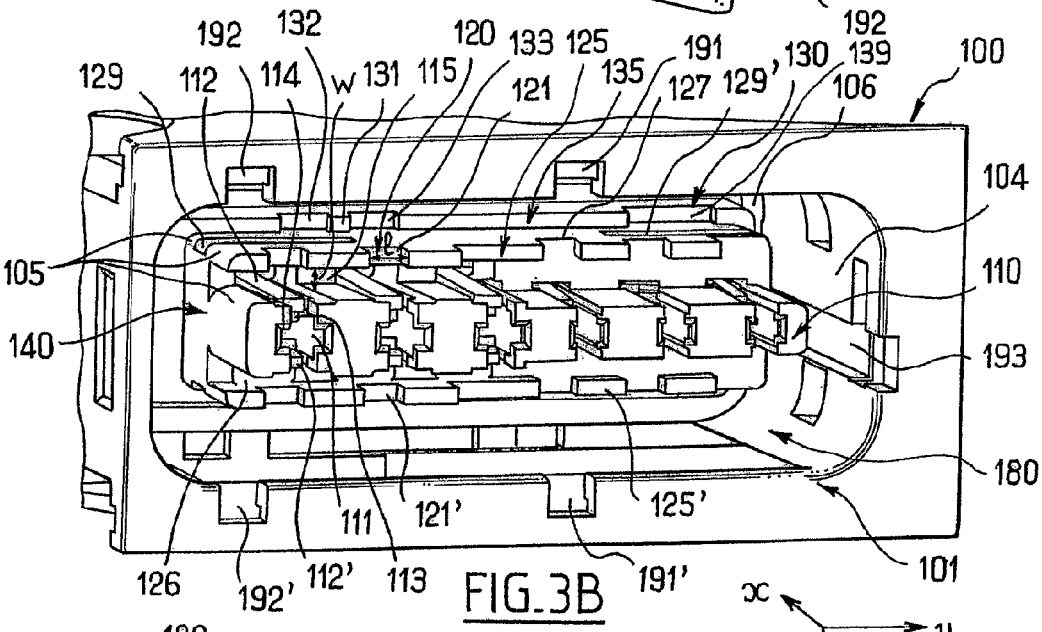

FIGS. 3A and 3B show a contact holder 100, provided for receiving and ensuring the fixation of a plurality of electrical contacts, here some female contacts. But the invention can of course be applied naturally and in the same manner to contact holder 100 arranged for receiving male electrical contacts;.

This contact holder 100 is formed by molding in an electrically insulator material, preferably in a rigid plastic material.

Such a contact holder 100 may constitute a module intended to be housed in a main connector housing, or constitute by itself a main connector housing.

The contact holder 100 may have a general parallelepipedic shape with an internal cavity 180. The internal cavity 180 is opened at the front face 101 of the contact holder 100, laterally closed by lateral walls or a shell 104 and by a rear panel 106 at the back side 102 of the contact holder 100.

Figure 3C:
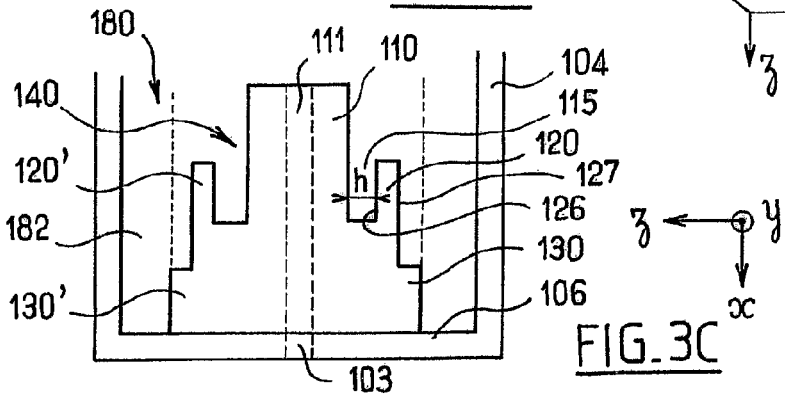
FIG. 3C shows a schematic cross-section in a (XZ) plane of the contact holder.

FIGS. 3A, 3B and 3C show a rigid core 140 extending inside the cavity 180 from the said rear panel 106 (i.e. the bottom of the cavity 180) according to the X-axis.

Figure 4:
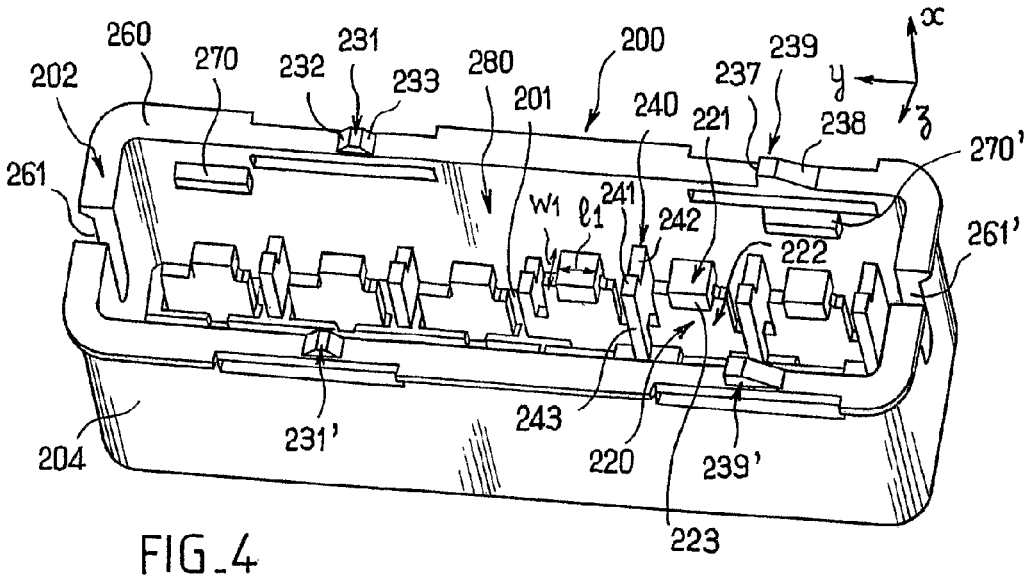
FIG. 4 shows a perspective rear view, of a front grid of an electrical connector according to the invention.

A main part of the core 140 is intended to be housed in a rear cavity 280 of the front grid 200 (see FIG. 4). Accordingly, the general shape and area of the cross-section (relative to the X-axis) of the core 140 is similar to the general cross-section of the front grid 200.

Additionally, the general cross-section (relative to the X-axis) of the core 140 is preferably rectangular with a length according to the Y-axis and a width according to the Z-axis. The rectangle has preferably rounded corners 105 in order to allow an annular sealing element 300 to be placed at its peripheral (not shown here). Particularly, the core 140 is sufficiently rigid for allowing the sealing element 300, engaged in force, to be pressed onto its outer faces, leading to a tight relation between the sealing element 300 and the core 140.

As shown in FIG. 3C, the core 140 leaves a peripheral volume 182 around it that extends along the X-axis from the bottom part of the cavity 180, arranged for receiving the sealing element 300 and then the lateral parts of a counterpart electrical connector 600.

The core 140 comprises the three, following main parts: a central part 110 and middle parts 120-120', side parts 130-130'. Each one of these three parts has a general parallelepipedic shape with a height according to the X-axis, a length according to the Y-axis and a width according to the Z-axis.

The said two side parts 130 and 130' extends from the rear panel 106 parallel to (XY) plane and constitutes the outer parts of the rigid core 140. The respective lengths of the side parts 130-130' are then approximately the same as the length of the whole core 140 and the distance between the side parts 130-130' is approximately the same as the width of the whole rigid core 140. The respective heights and widths of these side parts 130-130' are preferably constant along their lengths. The free edge 135 of each side part 130 is provided with a first recess 132, a second recess 133, and a third recess 139. Each one of these recesses 132-133-139 are limited along the Y-axis by stop walls extending perpendicular to the Y-axis. The first and second recesses 132-133 are separated by a squared shoulder 131.

The said central part 110, generally parallelepipedic, comprises a plurality of channels 111 extending according to the X-axis from the openings 103 of the rear side 102 of the contact holder 100 (see FIG. 1) to corresponding openings provided at the free edge of the central part 110. These channels 111 are arranged for receiving and fixing electrical contacts within. They are also arranged for receiving connecting elements of the counterpart electrical connector 600 engaged from the front side 101 of the contact holder 100. In order to facilitate the reception of these connecting elements, the openings of the channels 111 have optionally beveled surfaces 114.

Figure 5A:
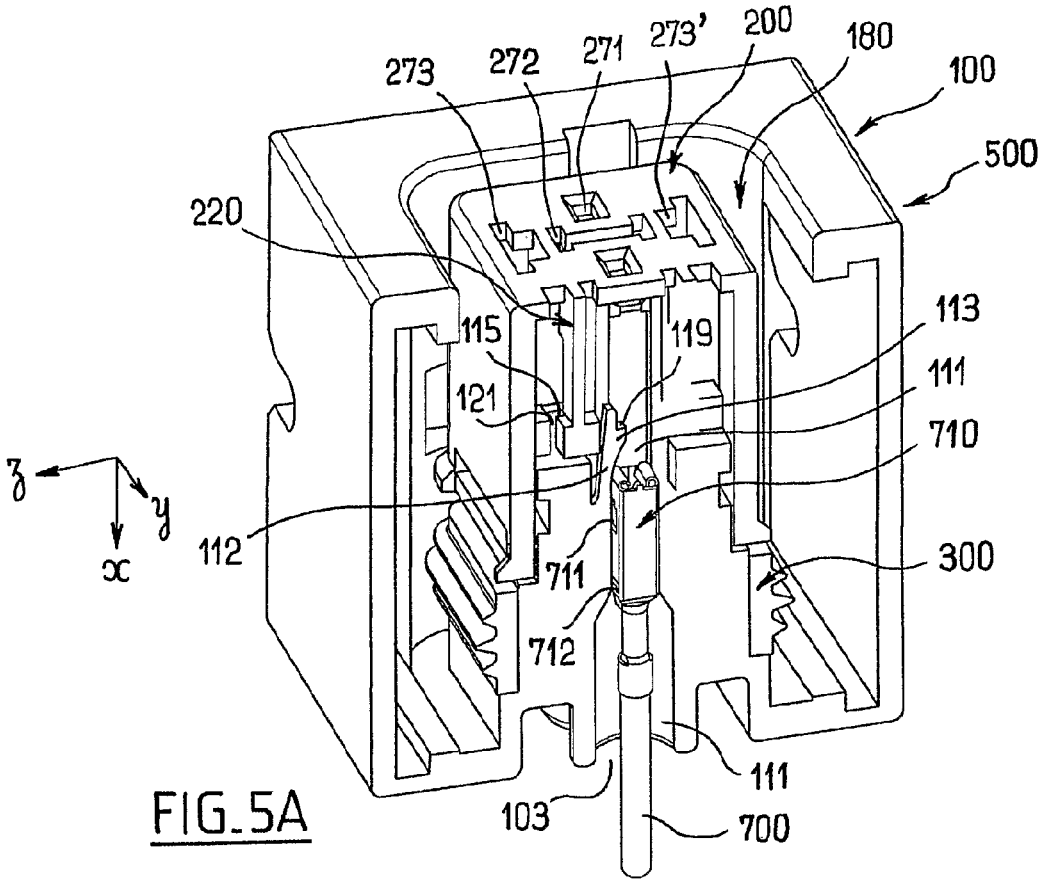
FIGS. 5A and 5B show respectively a partial perspective view and a cross-section according to (XZ) plane of an electrical connector of the invention, representing a first step of montage of the connector.
Figure 5B:
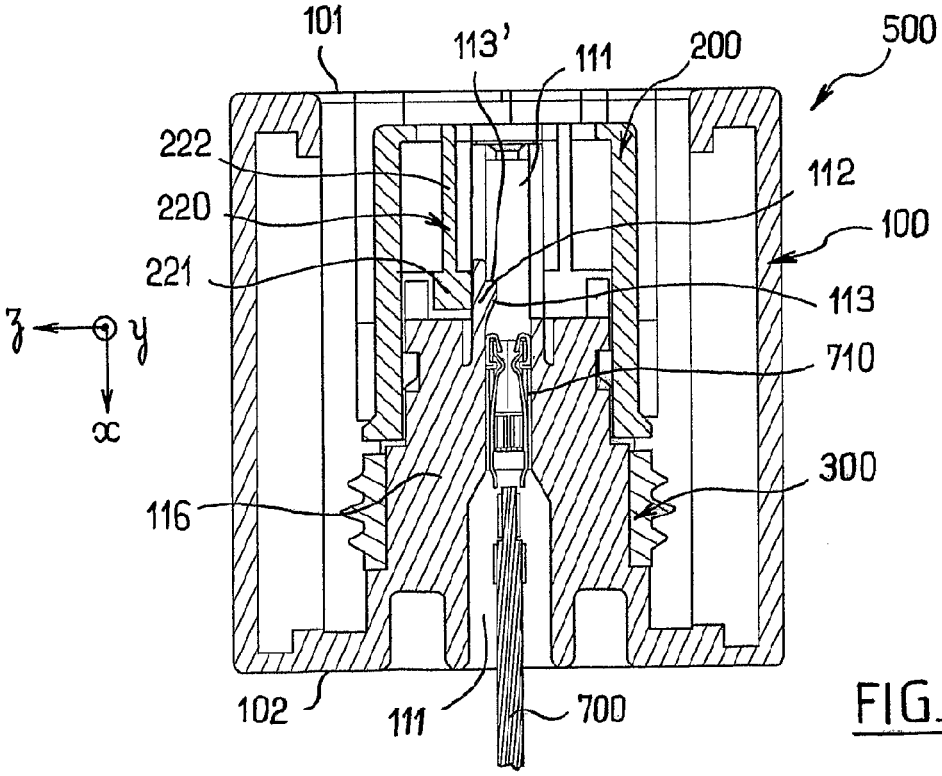

As shown on FIGS. 3B and 5B, a channel 111 is limited by lateral walls 116. One or two opposed lateral walls 116 are each extended from their respective end by a lateral resilient pawl 112-112'. Each relaxed pawl 112-112' turns its free end towards the axis of the associated channel 111 and comprises a shoulder 113 turned inwardly the channel 111. The side of the shoulder 113 directed to the front side 101 of the contact holder 100 is preferably a stop wall 113' perpendicular to the X-axis and the side of the shoulder 113 directed to the back part 102 of the contact holder 100 is preferably a ramp. The pawls 112-112' are able to be stressed outwards the axis of the associated channel 111 in the Z-direction if a pressure is exerted by an electrical contact engaged in the channel 111 and whose position in the channel 111 is not correct.

The said two middle parts 120 and 120' generally extend parallel to (XY) plane and are each located between the central part 110 and a corresponding side part 130-130'. The respective heights and widths of these middle parts 120-120' are preferably constant over their lengths. Each middle part 120-120' is separated from the central part 110 by a flank 115 having a determinate width "w". The contact holder 100 is further arranged such that a main inner surface 126 of at least one middle part 120-120' faces an resilient pawl 112-112'.

The free edge 125 of each middle part 120-120' is upper than the free edge 135 of each side parts 130-130'. The free edge 125 of each middle part 120-120' is also provided with recesses 121-121', each recess 121-121' facing a pawl 112-112'. Each recess 121 is limited in the Y-axis by stop walls 122 perpendicular to the Y-axis.

A main outer surface 127 of each middle part 120-120' is provided with slots 129-129' extending according to the Y-axis. Each slot 129-129' is limited in the Y-axis by stop walls perpendicular to the Y-axis.

Optionally, the core 140 may comprise channels 111 having different lengths. For example, the three first channels 111 from the left of the core 140 of FIG. 3B are longer than the three last channels 111. Accordingly, the dimensions and shapes of the three parts 110, 120, 130 are different regarding the kinds of channels 111. For illustration in FIG. 3B, it is to be noticed that the left part of the rigid core 140 has not the same dimension and shape as the right part.

Moreover, the core 140 may comprise one or several ranks of channels 111. In this case, one middle part 120 with adjacent flanks 115 is provided between each rank of channel 111.

FIG. 4 shows a front grid 200 according to the invention, able to be mounted to the contact holder 100 of FIGS. 3A-3B-3C.

This front grid 200 is formed by molding in an electrically insulator material, preferably in a rigid plastic material.

The front grid 200 may have a general parallelepipedic shape with an internal cavity 280. The internal cavity 280 is opened at the rear side 202 of the front grid 200, laterally closed by lateral walls or a shell 204 and by the said front panel 201. FIG. 2 shows that the front panel 201 is provided with connecting windows 271, optional testing windows 272 and optional dismounting windows 273. The connecting windows 271 are intended to face an associated channel 111 of the contact holder 100 once the front grid 200 is mounted into the contact holder 100.

The front grid 200 further comprises rear elongated elements 220-240 extending inside the cavity 280, parallel to the X-axis, from the bottom of the cavity 280 (i.e. from the rear side of the front panel 201). The elongated elements 220-240 are ordered in two opposed ranks (only one rank is visible in FIG. 4) generally parallel to the Y-axis, leaving a free volume between them for receiving the central part 110 of the contact holder 100 once the front grid 200 is mounted into the contact holder 100. Especially, the rear elongated elements are arranged for being able to be in contact with a pawl 112 of the contact holder 100.

A first sort of rear elongated element is a rear deflectable element 220 generally extending parallel to (XY) plane and arranged for being deflected according to the Z-axis if a determinate pressure is exerted according to the Z-axis onto one of its main surface. Especially, one rear deflectable element 220 is able to deflect under the pressure exerted by a stressed pawl 112 of the contact holder 100. Furthermore, the location of a rear deflectable element 220 corresponds, once the front grid 200 is mounted into the contact holder 100, to the location of a said flank 115 of the contact holder 100. The deflectable element 220 may comprise a thin leaf 222 having a terminal part 221. The width of terminal part 221 is eventually larger. The terminal part 221 is arranged for having a surface 223 in contact with a corresponding pawl 112 of the contact holder 100 once the front grid 200 is mounted into the contact holder 100. Moreover:

- the length "l1" of the terminal part 221 is similar as or inferior to the length "l" of a corresponding recess 121 of a middle part 120 of the core 140 of the contact holder 100; and
- the width "w1" of the terminal part 221 is similar as or inferior to the width "w" of a corresponding flank 115 separating a middle part 120 and the central part 110 of the core 140 of the contact holder 100.

Accordingly, a rear deflectable element 220 is able to slide inside the flank 115 once the front grid 200 is mounted to the contact holder 100, if the rear deflectable element 220 is not deflected. On the contrary, if the rear deflectable element 220 is deflected, the said widths and lengths are chosen such that the terminal part 221 is deflected into the corresponding recess 121. Accordingly, the terminal part 221 is stopped by a stop wall 122 of the corresponding recess 121 during the said sliding movement according to the Y-axis. Thus the sliding inside the flank 115 is not possible once the front grid 200 is mounted to the contact holder 100, and more generally the front grid 200 can not be displaced along the Y-axis with respect to the contact holder 200.

A second sort of rear elongated element is a rear rigid element 240 generally extending parallel to a (XZ) plane and arranged for being not deflected if a determinate pressure according to the Z-axis is exerted onto it. Especially, a rear rigid element 240 can not be deflected under the pressure exerted by a stressed pawl 112 of the contact holder 100. Specifically, an edge 243 of the rear rigid element 240 is arranged for being in contact with a corresponding pawl 112 of the contact holder 100 once the front grid 200 is mounted into the contact holder 100. The free edge of a rigid element 240 may comprise a squared shoulder 241 in order to leave then a neighbored complementary recess 242 through which the middle part 120 of the core 140 of the contact holder 100 can be engaged once the front grid 200 is mounted into the contact holder 100.

Accordingly, the rear rigid element 220 is able to slide relative to the core 140 once the front grid 200 is mounted to the contact holder 100, in spite of the presence of the said middle part 120.

In a rank of elongated elements, the rear deflectable elements 220 and the rear rigid elements 240 are disposed alternate. Especially, the location of the elongated elements is chosen with respect to the location of the transversal windows 271-272-273 of the front panel 201 of the front grid 200 (see FIG. 2). Then a couple of rear rigid elements 240 may extend from respective opposite sides of a connecting window 271, and a couple of rear deflectable elements 240 may extend from respective two portions separating a testing window 272 from respective two opposite dismounting windows 273-273' (see FIG. 9 for illustration).

Moreover, some internal faces of the shell 204 of the front grid 200 are provided with ribs 270-270' able to cooperate with the slots 129-129' of the contact holder 100 once the front grid 200 is mounted into the contact holder 100 according to the X-axis.

Additionally, the shell 204 of the front grid 200 is ended, at the rear side 202 of the front grid 200, by a flat edge 260 surrounded the entrance of the cavity 280. The longitudinal portions of the flat edges (i.e. according to the Y-axis) are designed for contacting the edges 135 of the side parts 130-130' of the core 140 of the contact holder 100 once the front grid 200 is mounted into the contact holder 100 according to the X-axis. Each longitudinal flat edge 160 holds a first shoulder 231-231' and a second shoulder 239-239'.

Each first shoulder 231 is intended to be housed in both the first and second recess 132-133 of a corresponding side part 130 of the core 140 of the contact holder 100. Each first shoulder 231 has also one first ramp 233 in order, if the first shoulder 231 is housed in the first recess 132, to slide on the squared shoulder 131, and go it beyond for being finally housed in the second recess 133. Optionally, each first shoulder 231 has further a second ramp 234 in order, if the first shoulder 231 is housed in the second recess 133, to slide on the squared shoulder 131, and go it beyond for being housed in the first recess 132.

Each second shoulder 239 is intended to be housed in the third recess 139 of a corresponding side part 130 of the core 140 of the contact holder 100. Each second shoulder 239 has a front ramp 238 in order to be slid into the third recess 139 if it is pushed opposite to the Y-direction, and a back wall 237 (perpendicular to the Y-axis) in order to stop the second shoulder 239 to a stop wall of the third recess 139 if the second shoulder 239 is pushed towards the Y-direction (the front grid 200 is then locked into the contact holder 100).

Moreover, some opposed openings 261 and 261' are provided in the lateral sides 204 (according to Z-axis) in order to allow the montage of the front grid 200 onto the core 140 of the contact holder 100 without making an abutment of these lateral sides to the core 140.

In the following, a method of montage of the electrical connector 500 according to the invention is detailed.

FIGS. 5A and 5B show that an annular sealing element 300 is firstly placed at the bottom of the internal cavity 180 of the contact holder 100, around the core 140.

According to FIGS. 3B and 4, the front grid 200 is then mounted into the contact holder 100 according to the X-axis until the ribs 270-270' of the front grid 200 cooperate with the associated slots 129-129' of the contact holder 100. In this position, the said first shoulders 231 of the front grid 200 are housed in the said first associated recesses 132.

From FIGS. 5A and 5B, it can be seen that, in this position, the connecting windows 271 do not face channels 111, but are offset from the channel 111 by a value that is substantially half the distance separating two consecutive connecting windows 271.

In this position, the rear deflectable elements 220 are located in a said flank 115, facing recesses 121, and are in contact with corresponding pawls 112. It is to be noted that the pawls 112 are not stressed. So they extend substantially parallel to the axes of the associated channels 111 with their free ends being slightly directed towards these axes. Accordingly, the pawls 112 do not apply pressure onto the neighbored corresponding rear deflectable elements 220.

Electrical contacts 700 are then engaged into the channels 111 of the contact holder 100 via a rear opening 103.

Each electrical contact 700 can comprise an electrical wire at the end of which a metallic terminal fitting 710 is crimped. It is shown here a female terminal fitting 710. It is to be noted that opposite faces of each terminal fitting 710 is provided with a window 712 such that the shoulder 113 of the associated pawl(s) 112-112' can be housed within if the terminal fitting 710 is sufficiently engaged into the channel 111. Eventually a second window 711 can be provided for defining a second stage of housing of the shoulder 119.

Figure 6A:
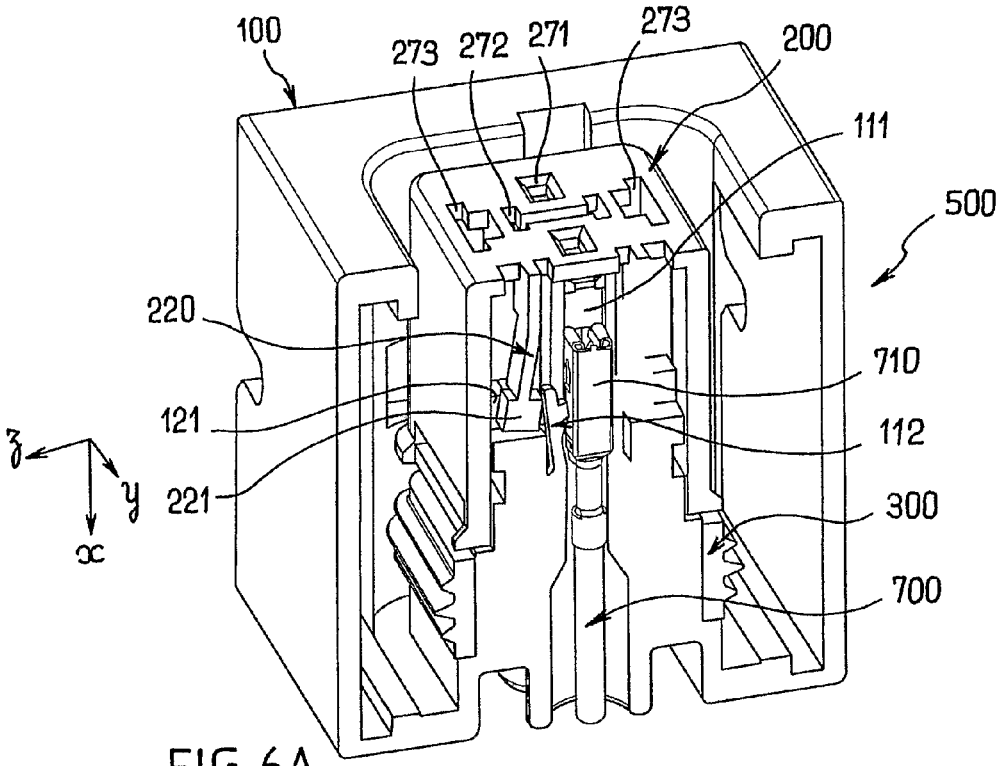
FIGS. 6A and 6B show respectively a partial perspective view and a cross-section according to (XZ) plane of an electrical connector of the invention, representing a second step of montage of the connector.
Figure 6B:
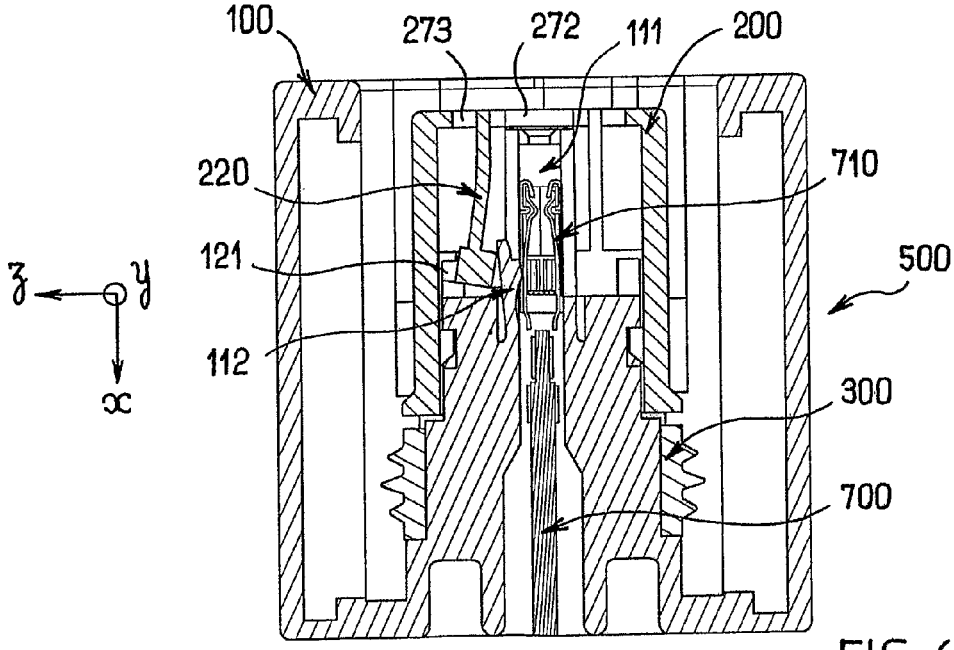

With reference to FIGS. 6A and 6B, once a terminal fitting 710 is in contact with associated pawl(s) 112-112', the force of engagement of the electrical contact 700 in the channel 111 is transmitted to the pawl 112. The pawl 112 is then stressed outwardly the axis of the channel 111 and presses the rear deflectable element 220 according to the Z-axis. The rear deflectable element 220 is then also deflected outwardly the axis of the channel 111. The terminal part 221 is then housed inside the corresponding recess 121.

Figure 7A:
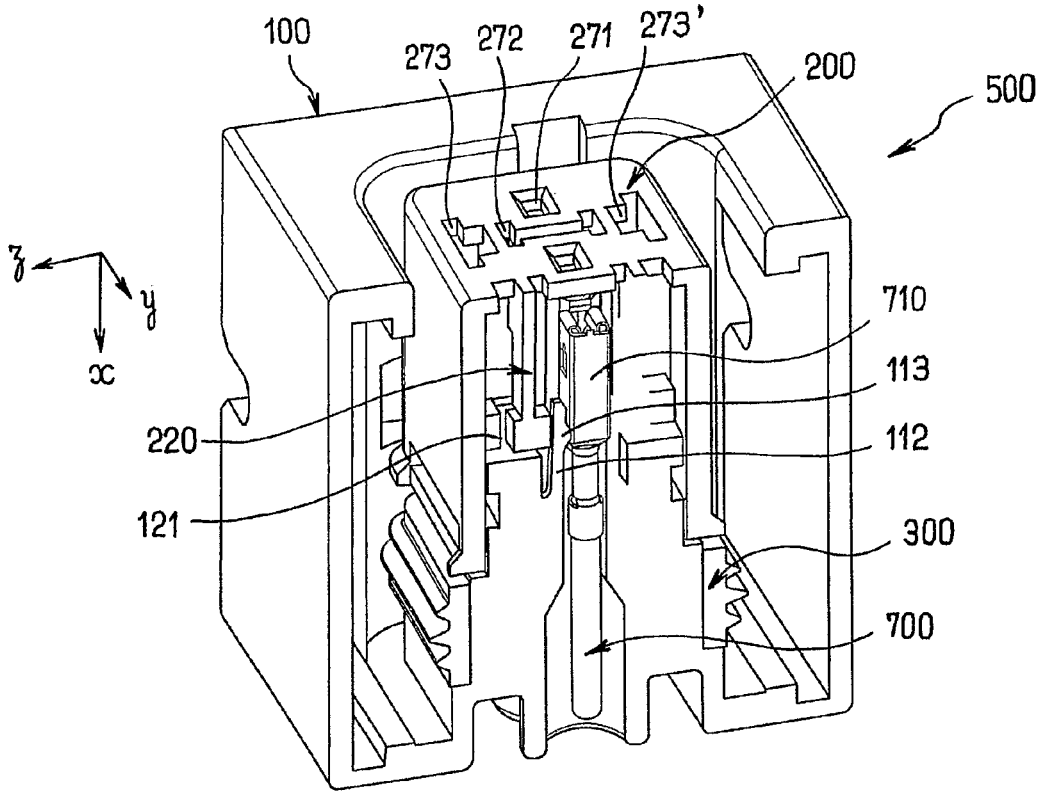
FIGS. 7A and 7B show respectively a partial perspective view and a cross-section according to (XZ) plane of an electrical connector of the invention, representing a third step of montage of the connector.
Figure 7B:
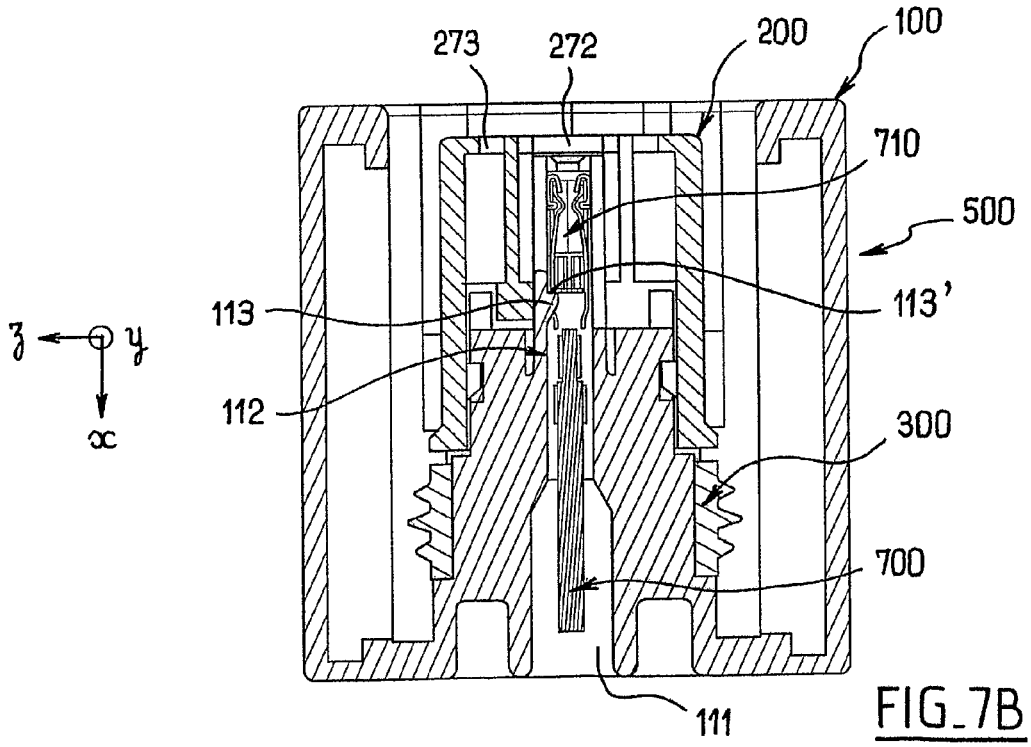

With reference to FIGS. 7A and 7B, once the said window(s) 712 of the terminal fitting 710 faces the shoulder 113 of the associated pawl(s) 112-112', this shoulder 113 is housed in the terminal fitting 710 through the window 712. The stress of the pawl 112 is then relaxed and the pawl 112 recovers its initial position or a position close to its initial position. Then, the rear deflectable element 220 stops to be deflected and recovers its initial position, i.e. inside the flank 115, facing the recess 121.

At this stage, the electrical contact 700 is clipped in the contact holder 100, the stop wall 113' preventing from a removal of the electrical contact 700 from the channel 111.

However, the electrical connector 500 is not usable yet, as the connecting windows 271 are offset from the channels 111 (as aforementioned)—it elements that a counterpart electrical connector 600 can not be engaged into channels 111 for the plugging.

A final stage consists then into locking the front grid 200 into the contact holder 100 by translating the front grid 200 into the Y-axis by a value corresponding to half the distance between two connecting windows 271.

From FIGS. 3B and 4, this step necessitates a minimum force and a minimum energy for involving that each first shoulder 231 is moved from the first recess 132, is gone beyond the associated squared shoulder 131 for finally being housed in the second recess 133. Furthermore, each second shoulder 239 is then housed in the associated third recess 139, and ensures the locking function thanks to the stop wall 237 of each second shoulder 239 and the stop wall provided at the ends of each recess 139, if the front grid 200 is pulled in an opposite direction.

As previously described, during this translation, the rear deflectable elements 220 are slid into the flank 115 by the said value. Of course the rear rigid elements 240 are also slid by the said value.

Figure 8A:
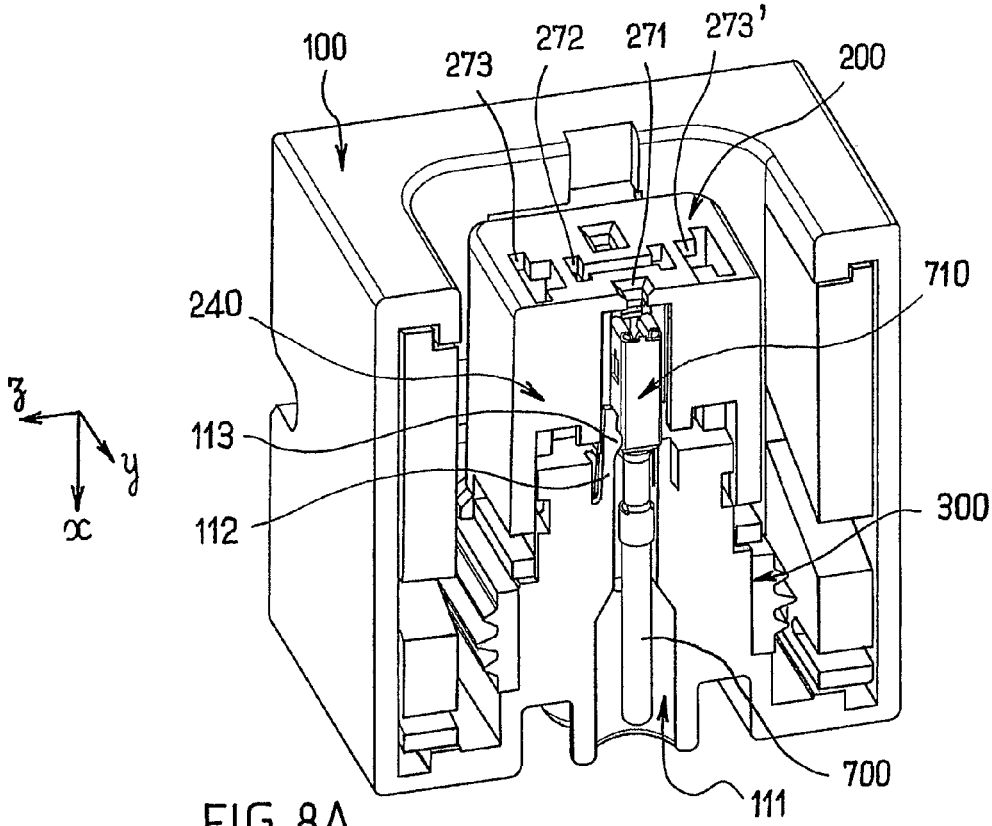
FIGS. 8A and 8B show respectively a partial perspective view and a cross-section according to (XZ) plane of an electrical connector of the invention, representing a fourth step of montage of the connector.
Figure 8B:
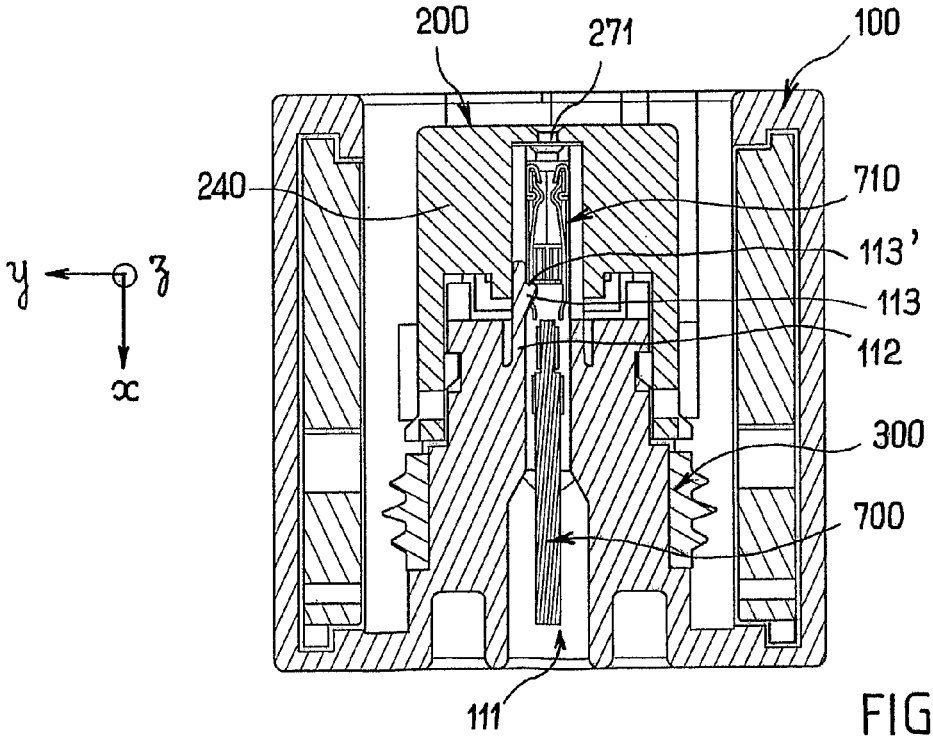

FIGS. 8A and 8B show the electrical connector 500 in such a locking position.

It can be seen that a rear rigid elements 240 is now in contact with the pawl 112.

The rear rigid element 240 prevents then from the deflection of the pawl 112 from its clipping position.

The rear rigid elements 240 ensure then the locking of the clipping of the electrical contact 700 in the electrical connector 500.

Moreover, the connecting windows 271 face now the channels 111, and the electrical connector 500 is then usable for the plugging.

Optionally, a U-bolt 400 is then engaged into the lateral gaps 171-172 of the contact holder 100 (see FIGS. 1 and 2) for latching the electrical connector 500.

Figure 9:
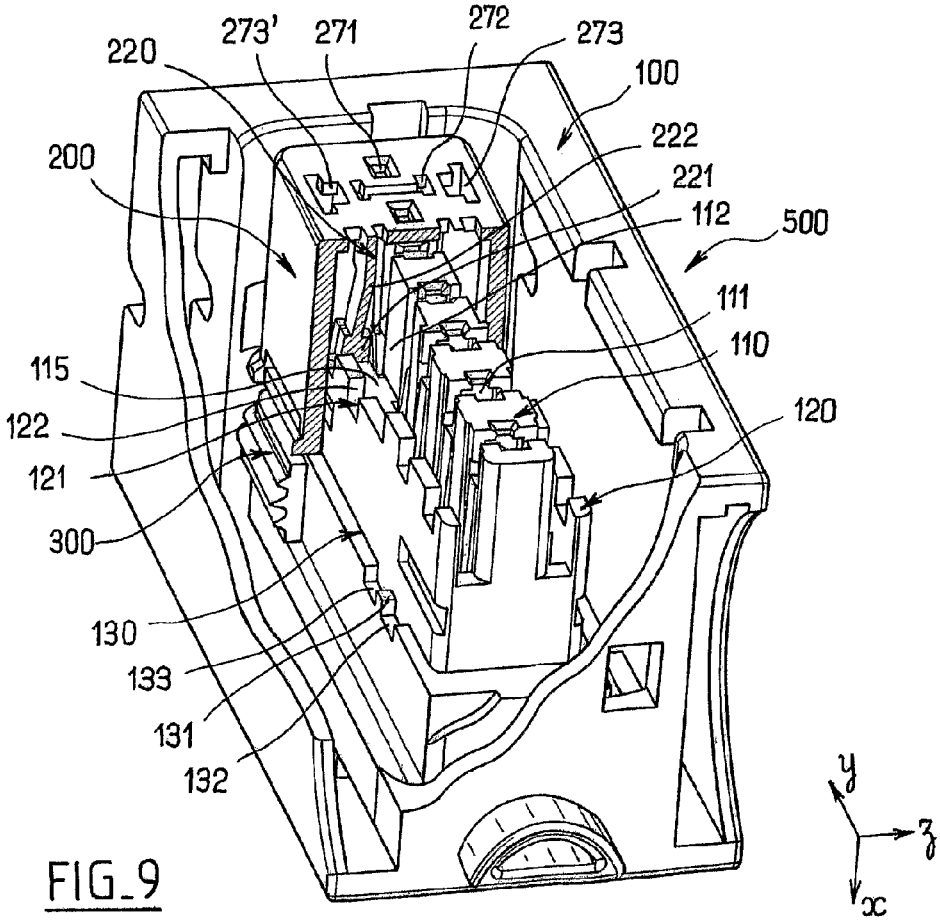
FIG. 9 shows a partial perspective view of an electrical connector having an electrical contact in a non-correct position.

FIG. 9 shows the case of an electrical connector 500 having one of its electrical contacts 700 not being in a correct position in the contact holder 100, i.e. a position such that the clipping of the electrical contact 700 with the pawl(s) 112-112' is not operated and the electrical contact 700 stresses the pawl(s) 112-112'. It is then the situation previously discussed with reference to FIGS. 6A-6B.

In this case, each associated rear deflectable element 220-220' is deflected in the recess 121. Accordingly, when the operator tries to implement the transversal locking step (according to the Y-axis) of the front grid 200 with respect to the contact holder 100, he is not able to succeed as the rear deflectable element 220 is stopped by the stop wall 122 ended the recess 121.

Accordingly, the invention proposes a transversal locking of the front grid 200 to the contact holder 100 that is allowed only if all the electrical contacts 700 are in a correct position within their associated channels 111.

Moreover, if this transversal locking is not done, the electrical connector 500 is not usable, as the connecting windows 721 are not facing the channels 111.

The electrical connector 500 of the invention allows then to ensure the operator that the electrical contacts 700 are in correct positions (i.e. that the electrical connector 500 was correctly mounted and/or has no manufacturing anomalies) and to hinder the use of the electrical connector 500 if one of the electrical contacts 700 is not in a correct position.

The invention claimed is:

1. Housing of an electrical connector comprising a contact holder and a front grid arranged for being mounted together, wherein: —the contact holder comprises channels extending parallel to a plugging axis for receiving electrical contacts within, each channel being limited by at least one axial lateral wall comprising resilient members; wherein each resilient element can be stressed in a stress direction perpendicular to the plugging axis by an electrical contact whose position in the channel is not correct; —the front grid comprises a front panel with a plurality of transversal connecting windows for facing corresponding channels of the contact holder; characterized in that the housing comprises members for locking the front grid to the contact holder by translating the front grid with respect to the contact holder according to a locking direction perpendicular to the said stress direction and to the plugging axis, in that the front grid further comprises rear members deflectable into the said stress direction by a neighbored stressed resilient members, and in that the contact holder comprises stop members arranged for stopping corresponding deflectable members, while the front grid is translated towards the locking direction, if the deflectable members are deflected, such that the front grid cannot be locked to the contact holder if one of the rear members is deflected.

2. The housing according to claim 1, wherein the deflectable members are deflectable leafs extending parallel to a plane perpendicular to the stress direction, wherein the stop members are stop walls perpendicular to the locking direction, two successive stop walls being separated to each other by a recess or a crenel, and wherein the stop walls and the deflectable members are arranged such that each deflectable element is housed in a corresponding recess if it is sufficiently deflected according to the stress direction.

3. The housing according to claim 1, wherein the resilient members are locking pawls able to lock the electrical contacts into the associated channels at correct positions, and wherein the front grid further comprises rear rigid members arranged for being in contact with corresponding locking pawls in order to strain them to stay in their locking position.

4. The housing according to claim 3, wherein the rigid members are leafs extending parallel to a plane perpendicular to the locking direction.

5. The housing according to claim 1, wherein the housing is designed for further receiving a sealing element between the front grid and the contact holder.

6. The housing according to claim 1, wherein the housing further comprises members for mounting the front grid to the contact holder according to the plugging axis.

7. The housing according to claim 1, wherein the said carrier holder comprises a rear panel comprising openings for engaging the electrical contact into the channels and a lateral shell extending from the rear panel for defining a front casing opened at a front side of the contact holder for engaging the front grid within, wherein the said channels are provided in a core portion of the contact carrier that extends inside the casing from the rear panel according to the plugging axis, and wherein the core portion further comprises the said stop members.

8. The housing according to claim 7, wherein the core portion is designed for holding an annular sealing element on its peripheral part.

9. The housing according to claim 7, wherein the said front grid comprises a lateral shell extending from the front panel defining a rear casing opened at the rear side for receiving the core portion within, and wherein the rear deflectable members extend inside the rear cavity from the front panel.

10. Housing of an electrical connector comprising a contact holder and a front grid arranged for being mounted together with: —mounting members allowing the montage of the front grid to the contact holder according to a plugging axis; and —locking members allowing the locking of the mounted front grid to the contact holder by translating the front grid with respect to the contact holder into a locking direction perpendicular to the plugging axis; and wherein: —the contact holder comprises: a rear panel having transversal openings; a lateral shell; a front cavity defined by the said rear panel and lateral shell, and opened at a front side for receiving the front grid; a core portion extending inside the cavity from the rear panel, having a plurality of inner channels extending parallel to the plugging axis from the openings of the rear panel for receiving corresponding electrical contacts within, each channel being limited by at least one axial lateral wall comprising one resilient locking pawl extending generally axial from the associated lateral wall; wherein each locking pawl is able to lock an electrical contact into the associated channel at a correct position and is able to be stressed outwards the axis of the associated channel in a stress direction that is perpendicular to the plugging axis and to the locking direction if the position of an electrical contact in the channel is not correct; —the front grid comprises a front panel with a plurality of transversal connecting windows for facing corresponding channels of the contact holder; rear members deflectable in the said stress direction by a neighbored stressed locking pawl; wherein the contact holder further comprises stop walls arranged for stopping corresponding deflectable members, while the front grid is translated towards the locking direction, if the deflectable members are deflected, such that the front grid cannot be locked to the contact holder if one of the rear members is deflected.

11. The housing according to claim 10, wherein the deflectable members are deflectable leafs extending parallel to a plane perpendicular to the stress direction, wherein the stop walls are perpendicular to the locking direction, two successive stop walls being separated to each other by a recess or a crenel, and wherein the stop walls and the deflectable members are arranged such that each deflectable element is housed in a corresponding recess, separating to successive stop walls, if it is sufficiently deflected according to the stress direction.

12. The housing according to claim 11, wherein the said front grid comprises lateral shell extending from the front panel for defining a rear casing opened at the rear side for receiving the core portion within, and wherein the deflectable members extend in the casing from the rear side of the front panel of the front grid.

13. The housing according to claim 10, wherein the front grid further comprises rear rigid members arranged for being in contact with corresponding locking pawls in order to strain them to stay in their locking position.

14. The housing according to claim 13, wherein the rigid members are leafs extending parallel to a plane perpendicular to the locking direction.

15. The housing according to claim 13, wherein the rigid members and the deflectable members are alternate along at least one rank.

16. The housing according to claim 10, wherein the contact holder is arranged for receiving a lateral U-bolt, in order to latch the electrical connector to the electrical contacts.

17. Contact holder of a housing according to claim 10, integrally molded in a plastic material.

18. Front grid of a housing according to claim 1, integrally molded in a plastic material.

19. Housing of an electrical connector comprising:

a contact holder; and a front grid arranged for being mounted with the contact holder, where the contact holder comprises channels extending parallel to a plugging axis for receiving electrical contacts within, each channel being limited by at least one axial lateral wall comprising a resilient member configured to be stressed in a stress direction perpendicular to the plugging axis by an electrical contact whose position in the channel is not correct;

where the front grid comprises a front panel with a plurality of transversal connecting windows for facing corresponding channels of the contact holder;

where the housing comprises members for locking the front grid to the contact holder by translating the front grid with respect to the contact holder according to a locking direction perpendicular to said stress direction and to the plugging axis, where the front grid further comprises rear deflectable members configured to be deflected into said stress direction by corresponding neighbored stressed resilient members, and where the contact holder comprises stop members arranged for stopping corresponding rear deflectable members, while the front grid is translated towards the locking direction, where the front grid cannot be locked to the contact holder if one of the rear deflectable members is deflected.

* * * * *